United States Patent [19]

Kunzmann

[11] Patent Number: 4,537,545

[45] Date of Patent: Aug. 27, 1985

[54] METHOD AND APPARATUS FOR ALIGNING A PILE OF SHEETS PROVIDED WITH PERFORATIONS FOR BINDINGS

[75] Inventor: Otto Kunzmann, Neuffen, Fed. Rep. of Germany

[73] Assignee: bielomatik Leuze GmbH & Co., Fed. Rep. of Germany

[21] Appl. No.: 494,967

[22] Filed: May 16, 1983

[30] Foreign Application Priority Data

Jun. 3, 1982 [DE] Fed. Rep. of Germany ..... 3220814

[51] Int. Cl.[3] ..... B24B 5/08; B24B 5/10

[52] U.S. Cl. ..... 412/7; 140/92.4; 412/38; 412/39

[58] Field of Search ..... 140/92.3, 92.4, 92.93 R, 140/92.93 A, 92.93 B, 92.94; 412/7, 38, 39

[56] References Cited

U.S. PATENT DOCUMENTS 4,161,196 7/1979 Fabrig ..... 140/92.4

FOREIGN PATENT DOCUMENTS 1817815 2/1972 Fed. Rep. of Germany .

2952183 6/1981 Fed. Rep. of Germany .

*Primary Examiner*—Paul A. Bell

*Attorney, Agent, or Firm*—Steele, Gould & Fried

[57] ABSTRACT

For aligning the binding perforations of a pile of sheets, straight prongs are inserted in the perforations and, during their withdrawal, are moved in non-positive manner in the direction of a curved shaped surface, so that the tip area of the prongs presses the back of the pile against the shaped surface and consequently the desired curved shape of the perforation is obtained.

15 Claims, 6 Drawing Figures

METHOD AND APPARATUS FOR ALIGNING A PILE OF SHEETS PROVIDED WITH PERFORATIONS FOR BINDINGS

The invention relates to a method and to an apparatus for aligning a pile of sheets provided with perforations for bindings, in which prongs are introduced into the perforations and the back of the pile is pressed by them against a curved shaped surface.

Piles of sheets often are bound together in so-called spiral or comb-like bindings, which have binding elements made from wire or plastic, whose turns or portions pass through the perforations. Piles thicker than a certain minimum thickness must be so prepared for binding purposes that the perforations, which after punching form a linear channel, have a curvature approximately corresponding to the helical curvature or the curvature of the individual portions of a comb-like binding, in order that a frictionless insertion of the binding in the perforations is ensured.

German Offenlegungsschrift No. 29 52 183 discloses an apparatus, in which alignment takes place by pressing the pile of sheets on to a curved shaped surface by means of straight prongs, which are inserted from both sides into the perforations and then moved out again. When the prongs are moved out they are tilted in accordance with the curvature, so that they also engage the outer areas of the back of the pile of sheets with the shaped surface. This procedure requires a very complicated mechanical gear, which must be precisely set to the desired curvature or sheet pile thickness, in order that there can be no tilting of the prongs in the perforations.

German Patent 18 17 815 discloses an apparatus, which operates with a shaped surface and curved prongs operating in opposite directions, but here again they must be adapted in accordance with the curvature.

The object of the present invention is to provide a method and an apparatus for aligning a pile of sheets provided with perforations for bindings, which operates simply and reliably and can be easily adapted to different circumstances.

According to the invention, this object is achieved by a method in which, starting from the center, the sheets are successively pressed against the shaped surface by the tip area of the prongs, displaced in a parallel alignment or manner in the direction of the shaped surface when they move out of the perforations.

Thus, the prongs do not have to be tilted about an axis parallel to the back of the sheets. Instead, the prongs are moved out, accompanied by a simultaneous movement in the direction of the shaped surface and "copy" the configuration of the shaped surface of the inner wall of the perforation directed towards the back.

The adjustment of the apparatus to different back curvatures, etc. is particularly simple, if pressing takes place in a non-positive manner, "non-positive" meaning in a resilient fashion providing for "give," as opposed to a positively-driven fashion in which the prongs would be forced to travel a fixed path having no provision for resilient deviation therefrom. In this case, the extension movement and the movement in the direction of the sheet back need not be precisely matched to one another. For example, during the forcibly controlled extension of the prongs, there can be a spring loading in the direction of the back of the sheet, which ensures the necessary pressing action.

In the case of spiral bindings, in which the wire coil to be turned into the perforations has a pitch, it is also necessary to align the perforations in accordance with this pitch. Whereas this was frequently previously carried out by external stops on the sides of the pile of sheets, it is possible here to carry this out without additional measures by inclining the prongs prior to their extension.

Thus, in the apparatus according to the invention, the prongs are provided on an insertion and removal device. The device is operable for inserting the prongs into the perforations and for the parallel removal thereof, while a pressing device being provided for moving the prongs in the direction of the shaped surface.

Preferably the straight prongs are aligned substantially perpendicularly to the pile of sheets when viewed longitudinally along the back.

On at least one edge associated with a thicker cover sheet in the pile of sheets, the rounded shaped surface advantageously has a recessed portion to receive the cover sheet and otherwise corresponds to the rounding of the back. This ensures that the cover sheet with its external perforation edge follows the curve formed by the inner faces of the bore pointing towards the back. Otherwise this outer edge of the cover sheet would project inwards somewhat and would, in certain cases, disturb the introduction of the spirals.

On both its upper and lower sides the shaped part can have comb-like guide portions, preferably provided with feed slopes, projecting over the shaped surface toward the pile. These guide portions can be linked laterally with the recessed portions such that the prongs pass through the slits between teeth of the comb-like configuration. These guide portions ensure that the pile of sheets, which cannot be secured during its alignment, does not fan out in this area.

Advantageously the prongs engaging different perforations from either side of the pile can be mechanically coupled together in their extension and advance movement. Thick sheet piles are frequently punched in several different layers. Should one layer be incorrectly punched, for example the perforation distance from the back being less than required, then the coupled copying movement of the prongs on either side still aligns the perforations in a precise arc. In such as case, the incorrectly punched sheet layer is not moved right up to the shaped surface, because the prong is controlled by the correctly punched sheets resting on the other layer.

The advantage resulting from the parallel guidance of the prongs during insertion and removal, is made particularly apparent if the apparatus is used for spiral bindings, where it is preferable for the prongs to be in each case pivotable about an axis with substantially the same angle, whereby said axis runs parallel to the pile and at right angles to its back. Otherwise there would be several reciprocally superimposing pivoting movements, which would be mechanically very difficult to realize. A relatively simple and reliable embodiment to manufacture provides that the prong holders carrying the prongs form part of a parallelogram guide. These parallelogram guides for the two rows of prongs can be provided on oppositely controlled rails. This makes it possible to simultaneously bring all the prongs into their inclined position as required to trace the pitch of spiral bindings and also to carry out the coupled, oppositely directed movement.

The invention is described in greater detail hereinafter with reference to the embodiments in the attached drawings, wherein.

Figure 1:
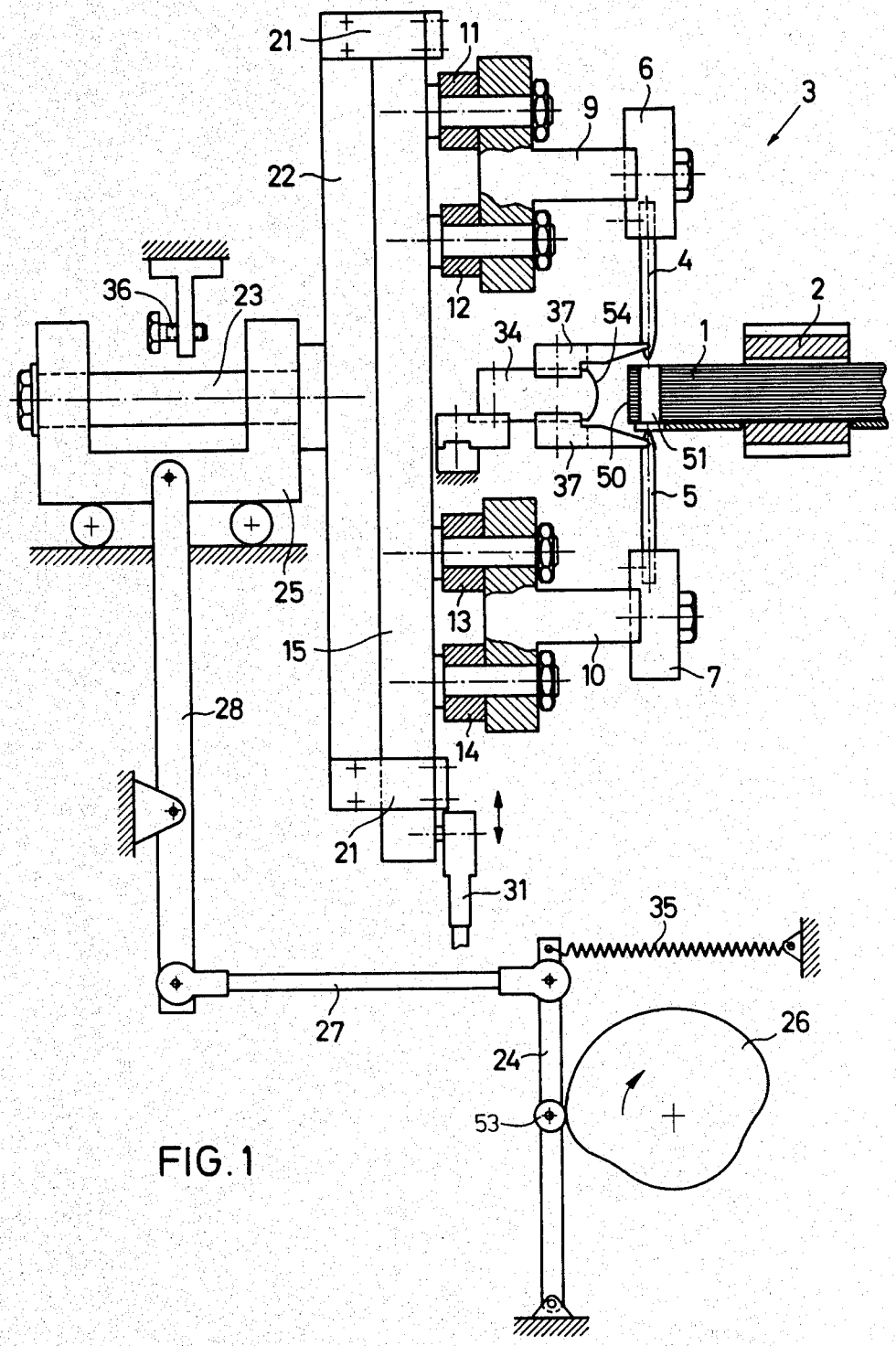
FIG. 1 is a part sectional side view of the apparatus.

A pile 1 of sheets is provided along its back or binding edge 50 with numerous juxtaposed, linear perforations 51 arranged in a row, for alignment. The pile is supplied at right angles to the drawing plane of apparatus 3 in FIG. 1, by means of a toothed belt, which can grip or release the pile between it by clamping. Upper and lower prongs 4, 5 are used for alignment purposes and comprise linear pins, which are also round in the case of round bores, with rounded, pointed, free ends. They are fixed in blocks 6, 7, which are adjustably screwed to prong holders 9, 10 by means of slots 8 (FIG. 2). In each case, the prong holders 9, 10 are pivotably fitted to two superimposed, horizontally directed ledges 11, 12 (for upper prong holder 9) and 13, 14 (for lower prong holder 10), whereby each ledge pair 11, 12 and 13, 14 forms a parallelogram guide.

The ends of the upper ledges 11, 12 are pivotably fitted to externally moving guide rails 15, 16 (FIG. 2), while each of the lower ledges 13, 14 is pivotably fitted by its end to inner guide rails 17, 18. Thus, with guide rails 15 to 18 and prong holders 9, 10, ledges 11 to 14 form a double, partly telescoped parallelogram, in which the prong holders 9, 10 form the pegs of a horizontally arranged ladder, whose superimposed cross members are displaceable relative to one another.

FIG. 2 shows that the guide rails 15 to 18 are so coupled together by pinions 19 and corresponding racks 20 on the guide rails, that they have a very precise opposite-sense movement during reciprocal displacement in guides 21. The guides provided at the top and bottom for the two carrier ledge pairs are in each case fixed to carriers, which are rotatably mounted by means of, in each case, one central, horizontal spindle 23, on a horizontal reciprocable slide 25 extending at right angles to the extension of the sheet pile back. An adjustable stop 36 limits the side movement.

The movement sequences of this mechanism are driven from a common synchronous shaft for the complete apparatus, which can e.g. be driven by a motor via a gear, and which drives cams 26, 29, 32.

Figure 2:
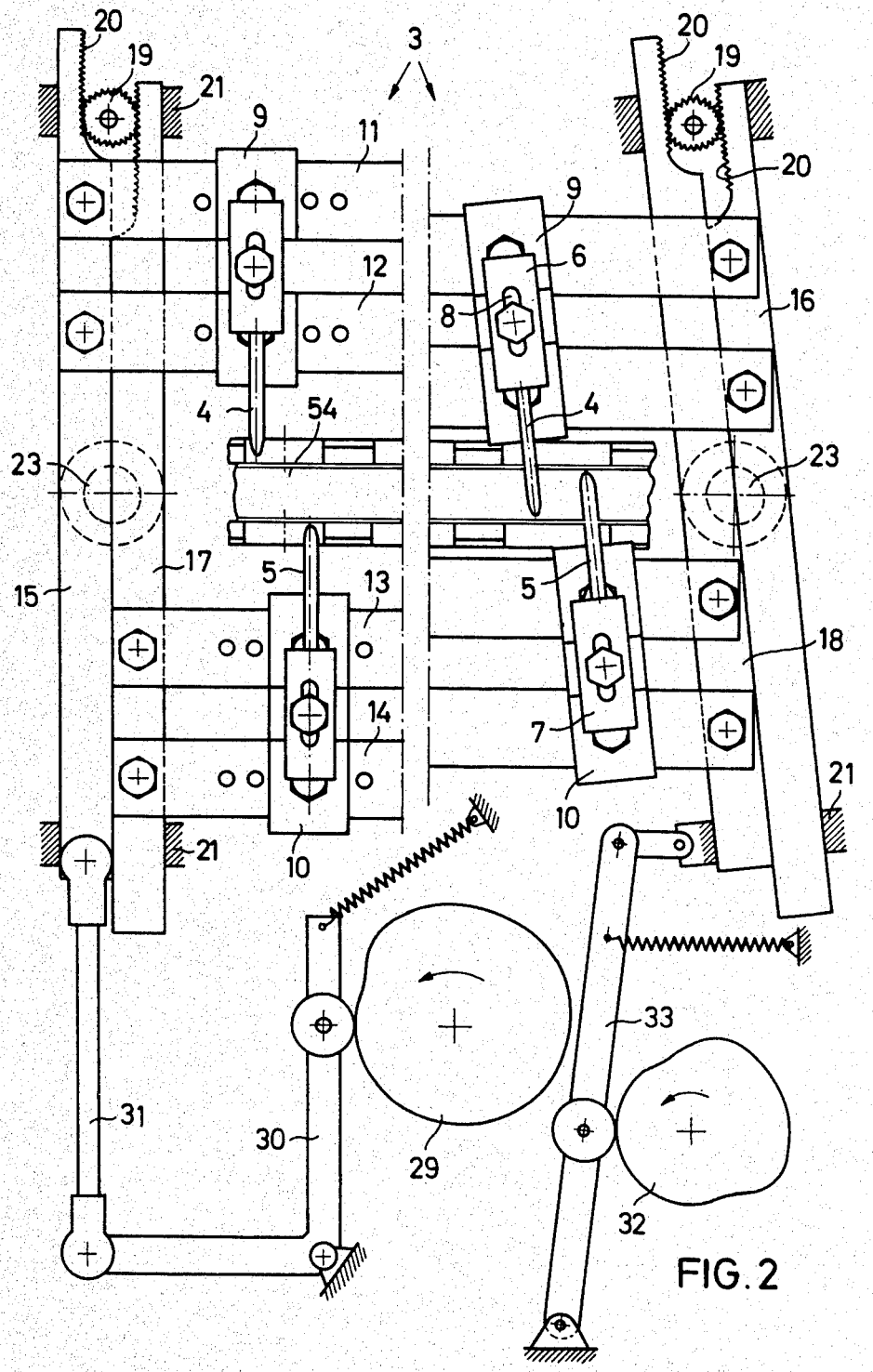
FIG. 2 is a view of the apparatus from the right in FIG. 1 (without a pile of sheets and its conveying mechanism), different operating positions being shown on both sides of the drawing.

FIG. 1 shows that the movement of slide 25 is controlled by means of a double-armed lever 28 and a connecting rod 27, as well as a lever 24 with a roller running on cam 26. A spring 35 loads the mechanism in such a way that the roller 53 is resiliently biased toward cam 26. Thus, it forms a resilient loading of the slide in a left-directed movement direction, which is limited by cam 26.

In the position shown in FIG. 1, the slide 25 is in its right-hand end position, in which the perforated sheet layer 1 is drawn into its alignment position with the upper conveyor belt 2 raised, by the insertion of prongs 4 and 5 into the perforations. The opposite-sense, coupled insertion of prongs 4, 5 into perforations 51 is controlled by cam 29 (FIG. 2), which by means of a linkage including angular lever 30 and a rod 31, moves the guide rail 15 downwards. Simultaneously, by means of rack 20 and pinion 19, a precisely oppositely directed upward movement is imparted to guide rail 17, so that the two prongs, which are oppositely directed, can each be inserted in guided manner into a stack of aligned perforations, the pins being inserted into neighboring holes, displaced relative to one another by one spacing. A coupling mechanism between the right-hand rack 15 and the left-hand rack 18 is provided, but is not shown in order not to overburden the drawing.

For using the apparatus for products provided with a spiral binding, a sloping device is provided for prongs 4, 5, which comes into action when the prongs are inserted into the perforations. It gives the perforations a sloping alignment in a plane parallel to the back, corresponding to the pitch of the wire coil to be helically-inserted into the perforations adjacent the back. For this purpose cam 32 shown in the right-hand half of FIG. 2 is provided, which by means of a lever 33, can pivot carrier 22 about spindles 23. The two carriers are coupled together in parallelogram-like manner by means of guide rails 15 to 18 and ledges 11 to 14, so that by means of their prong holders 9, 10, the prongs are all aligned in parallel, sloping manner to one another.

When using the apparatus for wire comb-like bindings, in which the portions engaging in the perforations have no slope or pitch in the direction along the back, the cam 32 can be disengaged and optionally spindles 23 can be blocked in slide 25.

The cooperation between cams 26 and 29 brings about the control of the alignment of the pile of sheets relative to the curvature of the perforation channel, corresponding to the curvature of the wire coil or comb-like binding to be turned in. Whilst cam 29 imparts to the prongs a preferably uniform extending movement out of perforations 51, a movement to the left in FIG. 1 is additionally imparted thereto, so that the prongs press the back of the sheet layers against a shaped surface 54. Shaped surface 54 is provided on a shaped part 34, which can comprise individual shaped blocks. Cam 26 is constructed in such a way that on pressing the prongs in the direction of the shaped surface 54, there is always a certain clearance between the cam 26 and cam roller 53. The pressing force is applied by tension spring 35 and cam 26 is operative only beyond a certain displacement. Thus, pressing takes place in a resilient manner rather than a positively-driven manner. Setscrew 36 forms the end stop in the movement of the movable apparaus part to the left.

The alignment method will now be described in detail relative to FIGS. 3 to 6.

The shaped part provided on a fixed part of the machine, i.e. not movable with respect to the previously described mechanism, has on its end pointing towards the back 50 of the pile of sheets, a moulded surface, which is generally a circular cylindrical surface with a horizontal orientation. It is bounded on either side by guide portions 37 projecting in the direction of the pile and which are constructed in comb or fork-like manner. Prongs 4 and 5 project into slits 40 between the tines or teeth of the guide portions. The tines have an insertion slope 41. In the area adjacent to the shaped surface, the guide portions have bearing surfaces 42, which roughly correspond to the pile thickness. For a pile having thicker cover sheets, slot-like portions 43 are provided on either side of the shaped surface 54 and correspond approximately to the cover sheet thickness.

Figure 3:
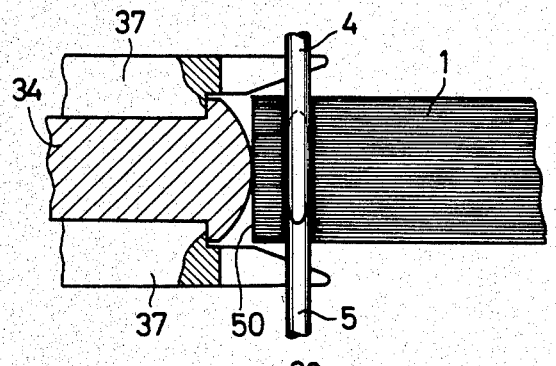
FIGS. 3 to 5 are partial section views in enlarged scale showing the pile of sheets, the shaped part and the prongs in three different operating positions.

FIG. 3 shows the straight prongs 4, 5 inserted into the straight holes and as a result pile 1 is brought into engagement with the shaped surface 54. After optionally sloping the prongs in accordance with the right half of FIG. 2, the prongs are now extended in the direction of arrows 38 in FIG. 4, whereby said prongs always remain at right angles to the plane of the pile, in the view shown in FIGS. 3 to 6, i.e. viewed along the pile back 50. Simultaneously the prongs are moved in the direction of arrow 39, under the action of spring 35, which is put into operation as a result of the fact that in this operating phase, cam 26 faces cam roller 53 with its recessed portion, so that there is a certain clearance between cam 26 and cam roller 53.

Figure 4:
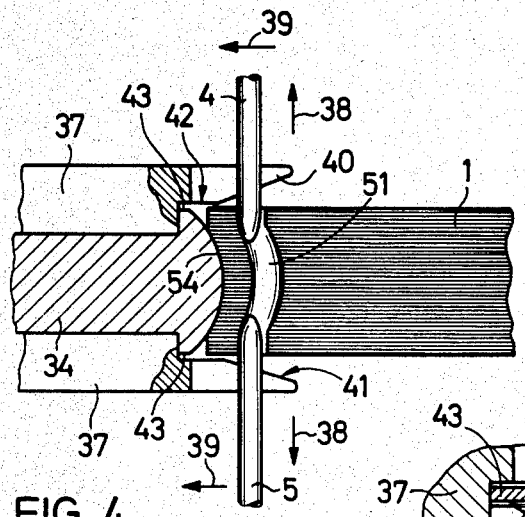

FIG. 4 shows that prongs 4, 5 are positioned such that their tip area is in contact with the inner faces of the bore defined by the stacked perforations, on a side facing the back 50. The resiliently-biased prongs start to move the sheets in the direction of sheet surface 54 in a successive manner as the prongs are withdrawn, starting from the center, i.e. the point located furthest right. The perforation channel initially only has a curved form in the central area and for the moment maintains a straight form in the area in which the prongs are still located, although the corresponding sheets have already been moved up. It is clear that the spherically chamfered tip form of the prongs is very advantageous, because it ensures a substantially flat engagement. It is also clear that in this operation, the prongs can have a significant thickness and the diameter thereof can almost correspond to that of the perforations, although they leave behind a very significantly curved bore. As a result the prongs are very stable and can transfer very considerable alignment forces.

Particularly if the prongs align the outer area of the pile, guide portions 37 and in particularly surfaces 42, prevent fanning out of the pile during alignment.

Figure 5:
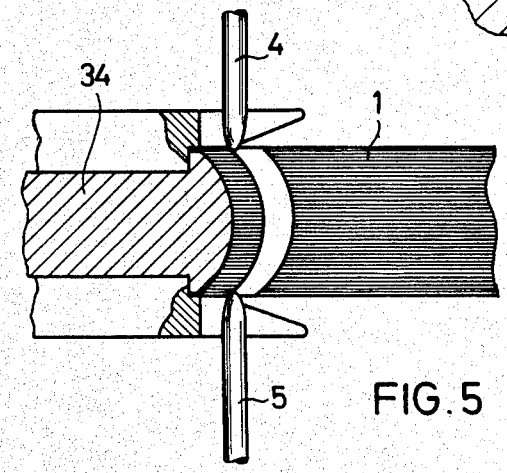

In FIG. 5, alignment is almost complete. Finally, the two cover sheets 55 are moved along both sides of the pile and then prongs 4, 5 are retracted from the stack. The prongs are extended upwards and downwards, without any further horizontal movement, once slide 25 engages with stop 36.

Figure 6:
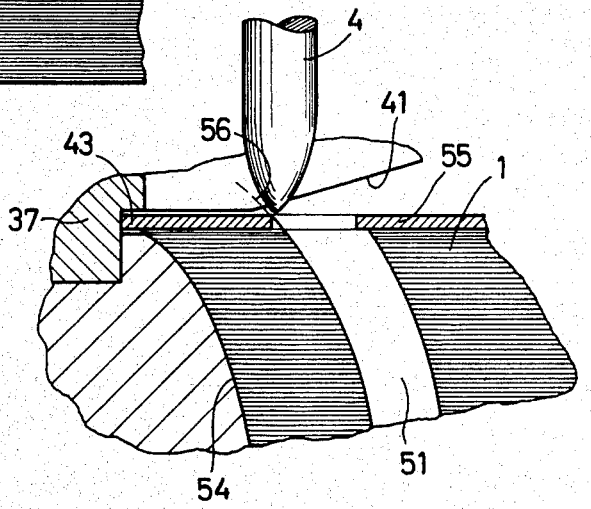
FIG. 6 is a view of a detail of FIG. 5 in even larger scale.

FIG. 6 shows a detail of the aligned pile of sheets. It can be seen that as a result of the recessed portion 43, cover sheet 55 can be moved somewhat more than would correspond to the normal curvature of shaped surface 54. As a result the upper edge of the cover sheet facing back 50 has been placed along the finished curve (broken line 56), so that an entering spiral on this side, which is critical during insertion, finds an open perforation. The resulting edge on the opposite side is not a problem upon spiral binding. Following on the extension of the prongs, the pile 1 is taken up again by the clamping together of toothed belt 2 and is conveyed in aligned form to the binding station.

Numerous modifications of the represented embodiment are possible within the scope of the invention. In place of a pressing movement of the prongs against the shaped surface, the shaped surface could be moved against the pile of sheets or the prongs. In place of spring 35, it would also be possible to use e.g. a pneumatic device or a weight for bringing about the necessary resilient and non-positive force closure. Normally it is advantageous to provide a prong, entering from above or below, for each perforation, particularly this permits the removal of any punching waste from the bores. However, it would also be possible to provide a smaller number of prongs, because even fewer prongs still have an adequate alignment action,

I claim:

1. A method for aligning a pile of sheets having perforations for receiving bindings, comprising the steps of:

moving two sets of prongs in opposite directions to insert said prongs into the perforations from opposite sides of the pile, the prongs of both sets being parallel to one another;

successively pressing an outer edge of the sheets in the pile against a shaped surface of a desired curvature from the center of the pile outwards for shaping the outer edge of the pile in correspondence with said shaped surface, by pressing tip portions of the prongs against inside edges of the perforations of successive sheets and holding both sets of prongs parallel to each other, and simultaneously urging said prongs toward the shaped surface while moving the prongs in opposite directions to be withdrawn from the pile.

2. The method of claim 1, wherein the prongs are resiliently urged against the edge of the perforations during said pressing.

3. The method of claim 1, wherein axes defined by the perforations in the pile of sheets are situated in a single plane before the prongs are inserted, and further comprising the step of sloping the prongs in said plane after inserting, but prior to said pressing and withdrawing.

4. An apparatus for aligning a pile of sheets having perforations for receiving bindings, comprising:

a shaped part having a surface conforming to a desired curvature for an edge of the pile of sheets;

two sets of generally-linear prongs, each set having a plurality of parallel prongs aligned for insertion in the perforations, the prongs of each set projecting opposite the prongs of the other set; and, driving means for the sets of prongs, adapted to insert the prongs into the perforations by moving each set relative to the other in a plane comprising the axes of the perforations before the prongs are inserted, and to withdraw the sets of prongs from the perforations, the prongs remaining aligned parallel to each other and remaining in said plane, the driving means having a resilient urging means to urge and move the prongs toward the shaped part while withdrawing the prongs from the perforations, whereby the pile of sheets is aligned by successive alignment of each sheet.

5. The apparatus of claim 4, wherein the prongs are straight and remain disposed perpendicular to the pile of sheets when viewed along said plane.

6. The apparatus of claim 4, wherein the urging means include a spring.

7. The apparatus of claim 4, wherein the shaped part has a recess at least at one edge thereof, the recess adapted for accomodating a cover sheet for the pile, whereby the cover sheet can be displaced from the curvature of the remainder of the pile of sheets by the recess.

8. The apparatus of claim 4, further comprising a guide portion attached to the shaped part and extending over the shaped part to guide the pile of sheets to the shaped part.

9. The apparatus of claim 8, wherein the guide portion defines an insertion slope having an opening wider than the pile of sheets.

10. The apparatus of claim 8, wherein the guide portion has openings for receiving the prongs.

11. The apparatus of claim 4, wherein said driving means comprises a coupling connecting the sets of prongs on opposite sides of the pile.

12. The apparatus of claim 11, further comprising means for coupling prongs for adjacent perforations.

13. The apparatus of claim 4, wherein the sets of prongs are pivotable about axes perpendicular to said plane, but remaining parallel to said plane.

14. The apparatus of claim 13, wherein the driving means includes a parallelogram guide to which the prongs are attached.

15. The apparatus of claim 14, wherein the parallelogram guide comprises two oppositely driven guides for the prongs.

* * * * *